US010302377B2

(12) United States Patent
Powell et al.

(10) Patent No.: US 10,302,377 B2
(45) Date of Patent: May 28, 2019

(54) SPLASH BAR MODULE AND METHOD OF INSTALLATION

(71) Applicant: SPX Cooling Technologies, Inc., Overland Park, KS (US)

(72) Inventors: Randall W. Powell, Louisburg, KS (US); Jeffrey McMillen, Overland Park, KS (US)

(73) Assignee: SPX COOLING TECHNOLOGIES, INC., Overland Park, KS (US)

( * ) Notice: Subject to any disclaimer, the term of this patent is extended or adjusted under 35 U.S.C. 154(b) by 156 days.

(21) Appl. No.: 15/058,639

(22) Filed: Mar. 2, 2016

(65) Prior Publication Data

US 2016/0231073 A1 Aug. 11, 2016

Related U.S. Application Data

(63) Continuation-in-part of application No. 14/540,465, filed on Nov. 13, 2014, now Pat. No. 10,240,877, which is a continuation of application No. 14/537,419, filed on Nov. 10, 2014, now abandoned.

(60) Provisional application No. 62/273,077, filed on Dec. 30, 2015, provisional application No. 61/903,112, filed on Nov. 12, 2013.

(51) Int. Cl.
*F28F 25/08* (2006.01)

(52) U.S. Cl.
CPC ..... *F28F 25/082* (2013.01); *Y10T 29/4935* (2015.01)

(58) Field of Classification Search
CPC ..... F28F 25/082; Y10T 29/4935
See application file for complete search history.

(56) References Cited

U.S. PATENT DOCUMENTS

| | | | | | |
|---|---|---|---|---|---|
| 2,197,970 | A | * | 4/1940 | Elmer | F28F 25/082 261/111 |
| 2,306,047 | A | * | 12/1942 | Elmer | F28F 25/082 261/108 |
| 2,470,652 | A | | 5/1949 | Scofield | |
| 2,630,305 | A | | 3/1953 | Scofield et al. | |
| 2,809,818 | A | | 10/1957 | Munters | |
| 2,898,097 | A | * | 8/1959 | Goldsmith | F28C 1/04 261/108 |
| 3,063,688 | A | * | 11/1962 | Fordyce | F28F 25/082 182/194 |
| 3,201,077 | A | | 8/1965 | Heimann | |
| 3,363,885 | A | * | 1/1968 | Meek | F28C 1/04 261/111 |
| 3,702,709 | A | | 11/1972 | Shaffer | |
| 3,743,257 | A | * | 7/1973 | Fordyce | F28C 1/04 165/900 |
| 3,751,017 | A | | 8/1973 | Lemmens | |

(Continued)

FOREIGN PATENT DOCUMENTS

| | | |
|---|---|---|
| DE | 1045432 B | 12/1958 |
| DE | 2619923 A1 | 11/1976 |

(Continued)

*Primary Examiner* — Stephen Hobson
(74) *Attorney, Agent, or Firm* — Baker & Hostetler LLP

(57) ABSTRACT

A fill support frame for an evaporative cooling tower includes a plurality of horizontal framing members, a plurality of columns, and a plurality of rails disposed on the horizontal framing members. The plurality of rails are configured to engage a plurality of slide members of a fill module.

9 Claims, 19 Drawing Sheets

(56) References Cited

U.S. PATENT DOCUMENTS 3,764,121 A * 10/1973 Fordyce ..... F28C 1/04 261/111
3,768,416 A * 10/1973 Juechter ..... B65D 19/38 104/135
3,804,389 A * 4/1974 Engalitcheff, Jr. ..... F28C 1/02 261/111
3,870,773 A * 3/1975 Luzaich ..... E04H 5/12 261/111
4,000,228 A * 12/1976 Chevakin ..... F28C 1/00 261/111
4,022,593 A 5/1977 Lerner
4,052,491 A * 10/1977 Lefevre ..... F28F 25/087 261/112.2
4,115,484 A * 9/1978 Saxton ..... F28F 25/082 261/111
4,164,378 A 8/1979 Linehan
4,195,873 A 4/1980 Johnston
4,269,794 A 5/1981 Bosne et al.
4,269,795 A * 5/1981 Bosman ..... F28F 25/082 248/340
4,299,785 A * 11/1981 Fougea ..... E04H 5/12 261/111
4,374,786 A * 2/1983 McClain ..... B01J 19/32 261/113
4,422,983 A * 12/1983 Bardo ..... F28C 1/00 261/111
4,454,079 A * 6/1984 Hoffmann ..... F28F 25/082 261/111
4,514,202 A * 4/1985 Kinney, Jr. ..... F28C 1/16 261/DIG. 11
4,515,735 A * 5/1985 Phelps ..... F28F 25/082 261/111
4,591,462 A 5/1986 Peterson
4,781,869 A * 11/1988 Wiltz ..... F28C 1/02 261/111
4,890,400 A 1/1990 Long
4,913,710 A * 4/1990 Reverdv ..... F28C 1/02 261/DIG. 11
5,155,961 A * 10/1992 Bardo ..... F28C 1/00 261/111
5,286,130 A 2/1994 Mueller
5,487,849 A * 1/1996 Curtis ..... F28C 1/02 261/110
5,851,446 A * 12/1998 Bardo ..... E04H 5/12 261/111
5,902,522 A * 5/1999 Seawell ..... E04H 5/12 261/111
6,022,164 A 2/2000 Tsui et al.
6,032,993 A 3/2000 Kwon
6,517,058 B1 * 2/2003 Engh ..... F28F 25/087 261/112.1
6,634,592 B1 10/2003 Berousek
6,652,012 B1 11/2003 Fuller et al.
7,603,774 B2 * 10/2009 Facius ..... F28C 1/14 261/153
8,756,955 B2 6/2014 Walchle et al.
2004/0150122 A1 8/2004 Engh et al.
2006/0163757 A1 * 7/2006 Mockry ..... F28F 25/082 261/111
2007/0176308 A1 * 8/2007 Shepherd ..... F28F 25/082 261/111
2011/0036542 A1 2/2011 Woicke
2011/0078976 A1 * 4/2011 Abeln ..... B66C 1/16 52/745.02
2011/0278871 A1 11/2011 Haun et al.
2012/0319312 A1 12/2012 Mockry et al.
2013/0047356 A1 2/2013 Meurville et al.
2014/0262140 A1 9/2014 Powell et al.
2015/0014869 A1 * 1/2015 Roth ..... F28C 1/00 261/24
2015/0130094 A1 * 5/2015 Powell ..... F28F 25/085 261/160
2015/0211818 A1 * 7/2015 Krell ..... F28F 25/082 261/146

FOREIGN PATENT DOCUMENTS

DE 2945870 A1 5/1981
JP 2007120919 A 5/2007
JP 4821269 B2 11/2011

* cited by examiner

SPLASH BAR MODULE AND METHOD OF INSTALLATION

CROSS REFERENCE TO RELATED APPLICATIONS

This application is a Continuation-in-part of U.S. patent application Ser. No. 14/540,465, filed on Nov. 13, 2014, which is a continuation-in-part of U.S. patent application Ser. No. 14/537,419, filed on Nov. 10, 2014, which claims priority to U.S. Provisional Application Ser. No. 61/903,112, filed on Nov. 12, 2013, titled "SPLASH BAR MODULE AND METHOD OF INSTALLATION," and this application claims priority to U.S. Provisional Application Ser. No. 62/273,077, filed on Dec. 30, 2015 the disclosures of which are incorporated herein by reference in their entireties.

FIELD OF THE INVENTION

This invention relates generally to an improved heat exchange splash bar apparatus and method for installing fill module in evaporative water cooling towers or the like. More particularly, the present invention relates, for example, to a fill module and method to improve the process of installing fill modules in evaporative water cooling towers.

BACKGROUND OF THE INVENTION

Generally, evaporative water cooling towers include an upper hot water distribution system. Examples of upper hot water distribution system may have a series of water distribution nozzles or an apertured distribution basin or the like, and a cold water collection basin positioned at the base or bottom of the cooling tower. Commonly, a splash-type water dispersing fill structure is disposed in the space between the hot water distribution system and the underlying cold water collection basin. The aforementioned fill structure oftentimes includes either a plurality of elongated, horizontally arranged and staggered splash bars supported at spaced intervals by an upright grid structure or frame assembly, or a series of fill packs composed of a number of film fill sheets. During assembly of the evaporative cooling towers, typically, an outer shell or support structure is built first and then a rack or grid support is affixed to the support shell. Splash bars are then threaded into the rack.

The splash bars generally provide a surface for consistent, predictable dispersal and breakup of the water droplets over a range of water loadings typically encountered during operation of the evaporative cooling tower. Typically, these splash bars are long and thin and the fill structure includes a great number of them. Unfortunately, the same characteristics that make an efficient splash bar and fill assembly also make the fill assembly difficult, tedious, expensive, and time consuming to install.

Accordingly, there is a need in the art to improve the installation of a splash bar apparatus.

SUMMARY OF THE INVENTION

The foregoing needs are met, to a great extent, by the present invention, wherein aspects of a splash bar module and method of installation are provided.

An aspect of the present invention pertains to a fill support frame for an evaporative cooling tower. The fill support frame includes a plurality of horizontal framing members, a plurality of columns, and a plurality of rails disposed on the horizontal framing members. The plurality of rails are configured to engage a plurality of slide members of a fill module.

Another aspect of the present invention relates to a fill module in an evaporative cooling tower. The fill module includes a grid, a grid support, a module support, a module column, a plurality of module girts, and a plurality of slide members. The grid is to support a plurality of splash bars. The grid support is configured to provide support for the grid. The module support is configured to provide support for the grid support. The module column is configured to provide support for the module support. The plurality of module girts are to provide support for the module columns. The plurality of slide members are configured to facilitate sliding the fill module on a plurality of rails in the evaporative cooling tower.

Yet another aspect of the present invention relates to a method for installing a fill in an evaporative cooling tower. In this method, a fill module is assembled. The fill module includes a grid, a grid support, a module support, a module column, a plurality of module girts, and a plurality of slide members. The grid is to support a plurality of splash bars. The grid support is configured to provide support for the grid. The module support is configured to provide support for the grid support. The module column is configured to provide support for the module support. The plurality of module girts are to provide support for the module columns. The plurality of slide members are configured to facilitate sliding the fill module on a plurality of rails in the evaporative cooling tower. The assembled fill module is lifted. The plurality of slide members are engaged with the plurality of rail. The fill module is slid into the evaporative cooling tower.

There has thus been outlined, rather broadly, certain aspects of the invention in order that the detailed description thereof herein may be better understood, and in order that the present contribution to the art may be better appreciated. There are, of course, additional aspects of the invention that will be described below and which will form the subject matter of the claims appended hereto.

In this respect, before explaining at least one aspect of the disclosure in detail, it is to be understood that the invention is not limited in its application to the details of construction and to the arrangements of the components set forth in the following description or illustrated in the drawings. The invention is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Figure 1:
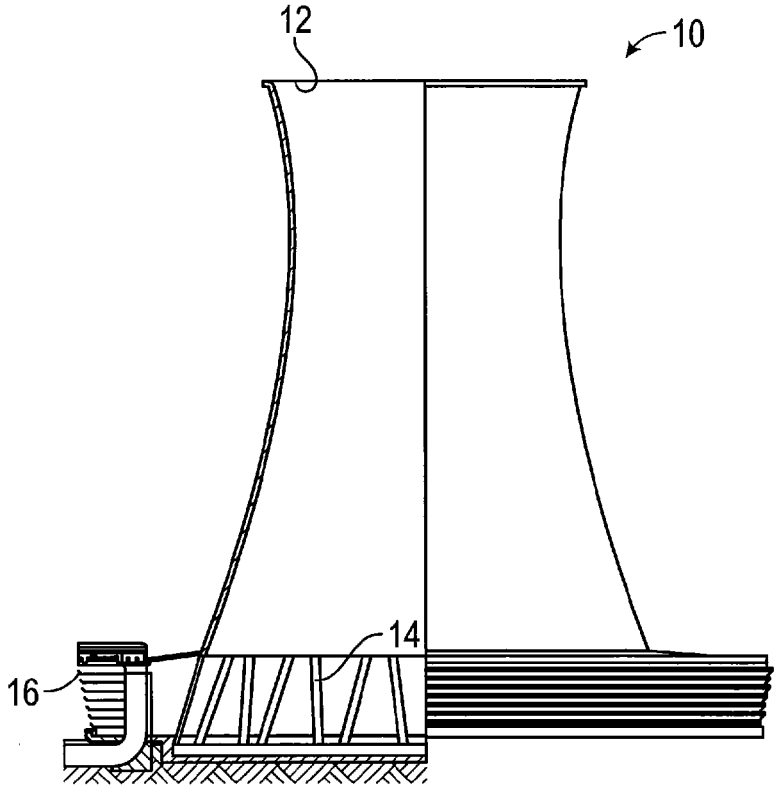
FIG. 1 is a partial cross sectional view of a cooling tower suitable for use with an aspect of the present invention.

The drawings presented are intended solely for the purpose of illustration and therefore, are neither desired nor intended to limit the subject matter of the disclosure to any or all of the exact details of construction shown, except insofar as they may be deemed essential to the claims.

DETAILED DESCRIPTION

Various aspects of the present invention provide for an improved fill assembly method of installing the improved fill assembly in the cooling tower. Preferred aspects of the invention will now be further described with reference to the drawing figures, in which like reference numerals refer to like parts throughout.

Turning now to the drawings, FIG. 1 is a partial cross sectional view of a cooling tower 10 suitable for use with an aspect of the present invention. As shown in FIG. 1, the cooling tower 10 includes a shell 12, support structure 14, and fill support frame 16. In general, the cooling tower 10 is configured to generate a natural draft of cooling air that is drawn in through the fill support frame 16 and up and out the shell 12.

Figure 2:
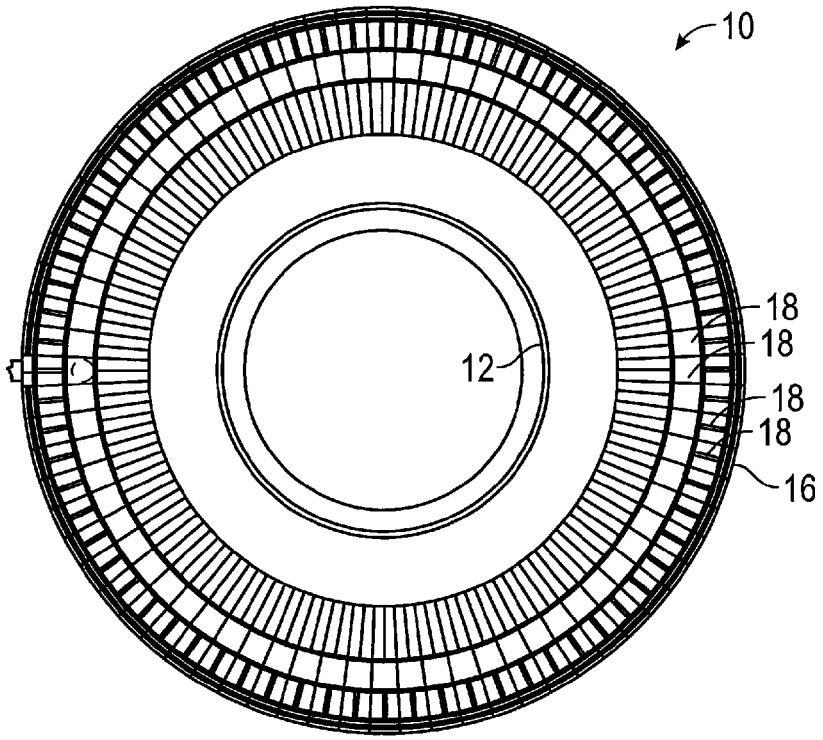
FIG. 2 is a cross sectional top view of the cooling tower depicted in FIG. 1.

FIG. 2 is a cross sectional top view of the cooling tower 10 depicted in FIG. 1. As shown in FIG. 2, the fill support frame 16 includes a plurality of radial framing members 18. As shown herein, the fill is disposed between the radial framing members 18.

Figure 3:
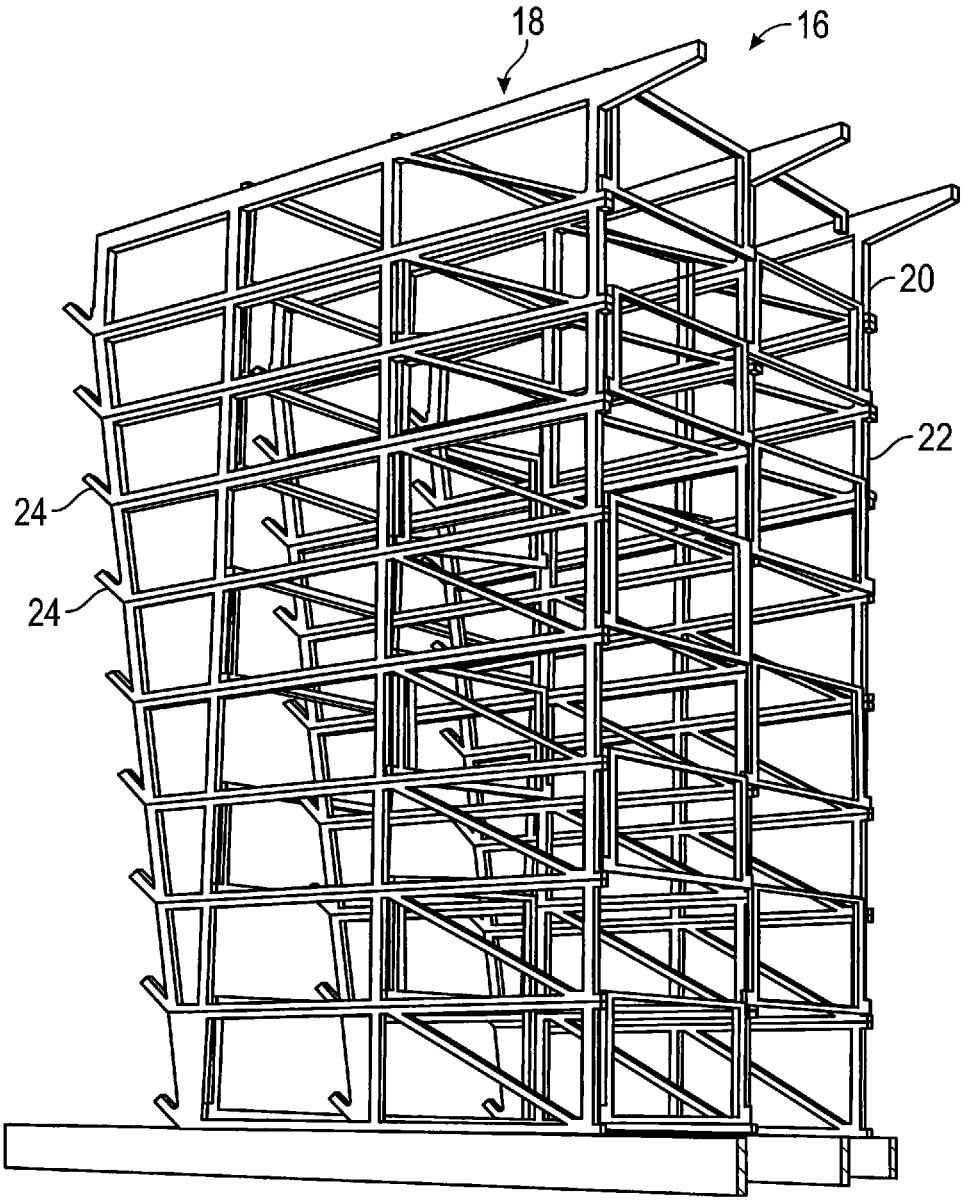
FIG. 3 is a perspective side view of a frame for a fill module according to an aspect of the disclosure.

FIG. 3 is a perspective side view of the fill support frame 16 for a fill module according to an aspect of the disclosure. As shown in FIG. 3, the fill support frame 16 includes the radial framing members 18, a plurality of circumferential framing members 20, column framing members 22, and louver support members 24. In general, these framing members may be made from any suitable material. An example of a suitable material includes steel reinforced concrete. This material is suitable due to its ability to withstand extremely humid environments.

Figure 4:
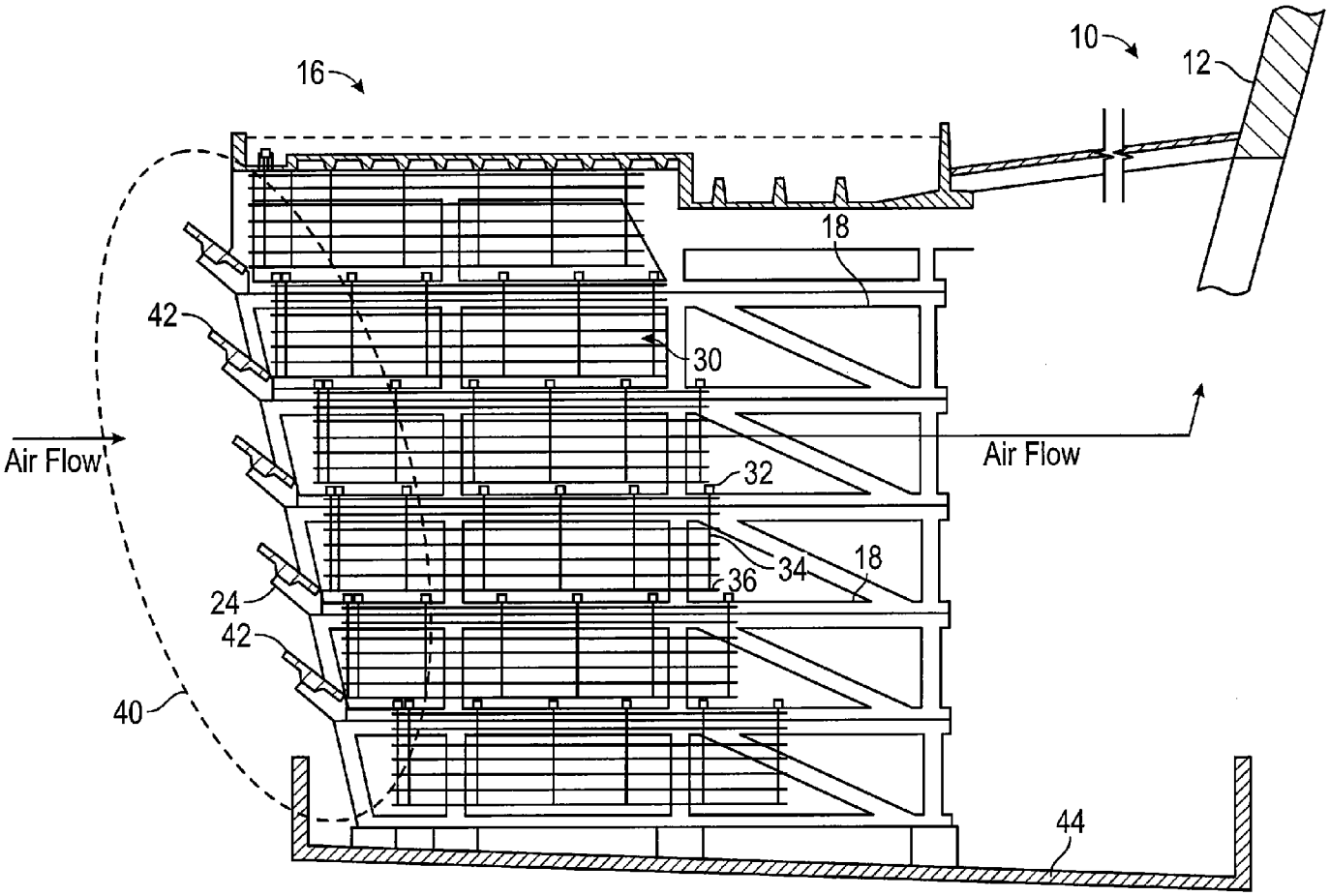
FIG. 4 is a side view of a conventional fill installation in a frame of a cooling tower.

FIG. 4 is a side view of a conventional fill installation in a frame of a cooling tower 10. As shown in FIG. 4, a conventional fill 30 includes fill support beams 32, fill support grids 34, and fill bars 36. This conventional fill 30 is installed in-place so that the fill support grids 34 can be hung from the fill support beams 32. Thereafter, the fill bars 36 are individually installed in the fill support grids. Of note, these structures are extremely tall and the work to install the conventional fill 30 is meticulous and time consuming. Due to the height, the work requires time consuming safety practices.

The conventional fill 30 is periodically changed to replace damaged fill bars 36. One source of damage is due to ice at an air inlet area 40. In operation, water is deposited at the top of the fill support frame 16 to cascade down through the conventional fill 30. Heat is removed from the water via air entering the air inlet area 40. A plurality of louvers 42 help direct water back into the fill support frame 16. The cooled water collects in a catch basin 44 and this water may be returned to a heat generating facility such as a power plant or the like (not shown). Cold air entering the fill support frame 16 may freeze the water nearest the air inlet area 40. Icicles or other large formations of ice may form and then break and fall on the fill bars 36 causing damage.

Figure 5:
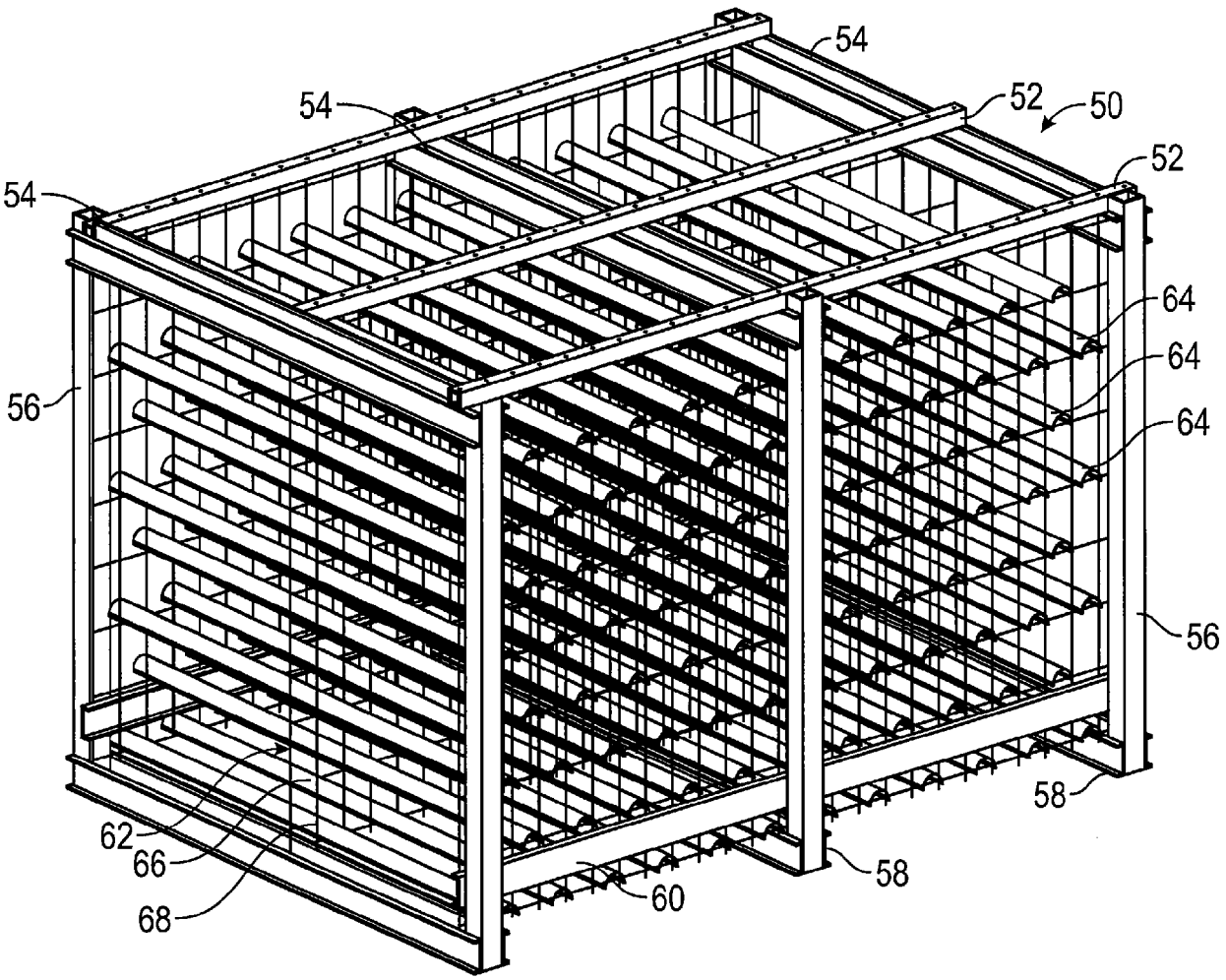
FIG. 5 is a perspective view of the fill module according to an aspect of the disclosure.

FIG. 5 is a perspective view of a fill module 50 according to an aspect of the disclosure. As shown in FIG. 5, the fill module 50 includes a plurality of grid supports 52, module side supports 54, module columns 56, module side girts 58, module end girts 60, grids 62, and splash fill bars 64. The grid supports 52 are configured to provide support for the grids 62 to hang from. The module side supports 54 are configured to provide support for the grid supports 52. The module columns 56 are configured to provide support for the module side supports 54. The module side girts 58 are configured to rest on the fill support beams 32 and provide support for the module columns 56. For example, the module side girts 58 are configured to rest on the fill support beams 32, and/or the like. The module end girts 60 are configured to help strengthen the fill module 50.

The grids 62 are configured to retain the splash fill bars 64. In a particular example, the grids 62 include horizontal members 66 and vertical members 68 that cross each other to for a grid-like pattern. Individual splash fill bars 64 are disposed in the openings formed by the horizontal members 66 and vertical members 68.

In a particular example, the fill module 50 is preassembled and can be quickly installed in the fill support frame 16 or other such crossflow cooling tower. Aspects of the fill module 50 save labor costs by allowing the fill module to be assembled at ground level and/or in a manufacturing facility rather than taking place at a height that is typically less efficient. This has the advantage on fill replacement jobs of shortening the elapsed construction time and may greatly reduce down-time of a power plant. Thus, power plant outages may be shorter to accomplish restoration of cooling capacity which can result in economic benefit to the power producer.

The grid supports 52, module side supports 54, module columns 56, module side girts 58, module end girts 60, and splash fill bars 64 may be made from any suitable material. Examples of suitable materials include fiber reinforced plastics (FRP), stainless steel or galvanized steel. The grids 62 may be made from any suitable material such as polypropylene, FRP, stainless steel, galvanized steel, polyvinyl chloride (PVC) coated steel, or another such corrosion resistant construction material. The splash fill bars 64 may be made from any suitable material such as FRP, PVC, rust resistant or coated metal, and the like. The fill modules 50 may be preassembled off site and transported to the cooling tower 10 site or they may be assembled on site at grade near the cooling tower 10.

Figure 6:
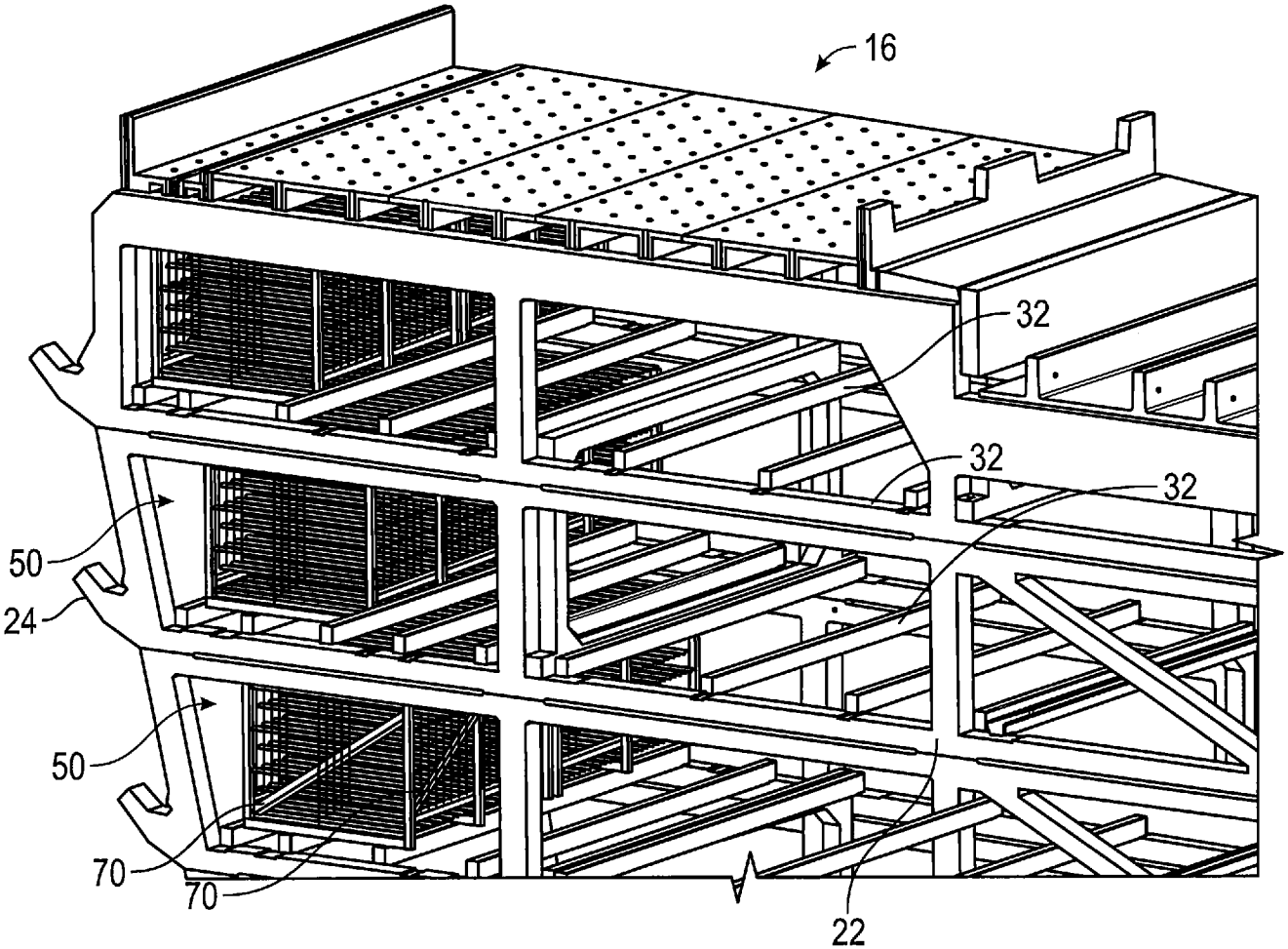
FIG. 6 is a perspective view of the fill module installed in the frame according to an aspect of the disclosure.

FIG. 6 is a perspective view of the fill module 50 installed in the fill support frame 16 according to an aspect of the disclosure. As shown in FIG. 6, the fill module 50 may be disposed upon the fill support beams 32 of the fill support frame 16. In a particular example, the louvers 42 (shown in FIG. 4) have been removed to allow the fill modules 50 to be lifted an inserted with a fork lift, crane, hoist, or the like. In this manner, the fill module 50 having a height that is about equal (slightly less) than the distance between the fill support beams 32 of one layer to the next of the fill support frame 16 may be inserted directly into the fill support frame 16. Also shown in FIG. 6, the fill module 50 optionally includes one or more diagonal bracing 70.

Figure 7:
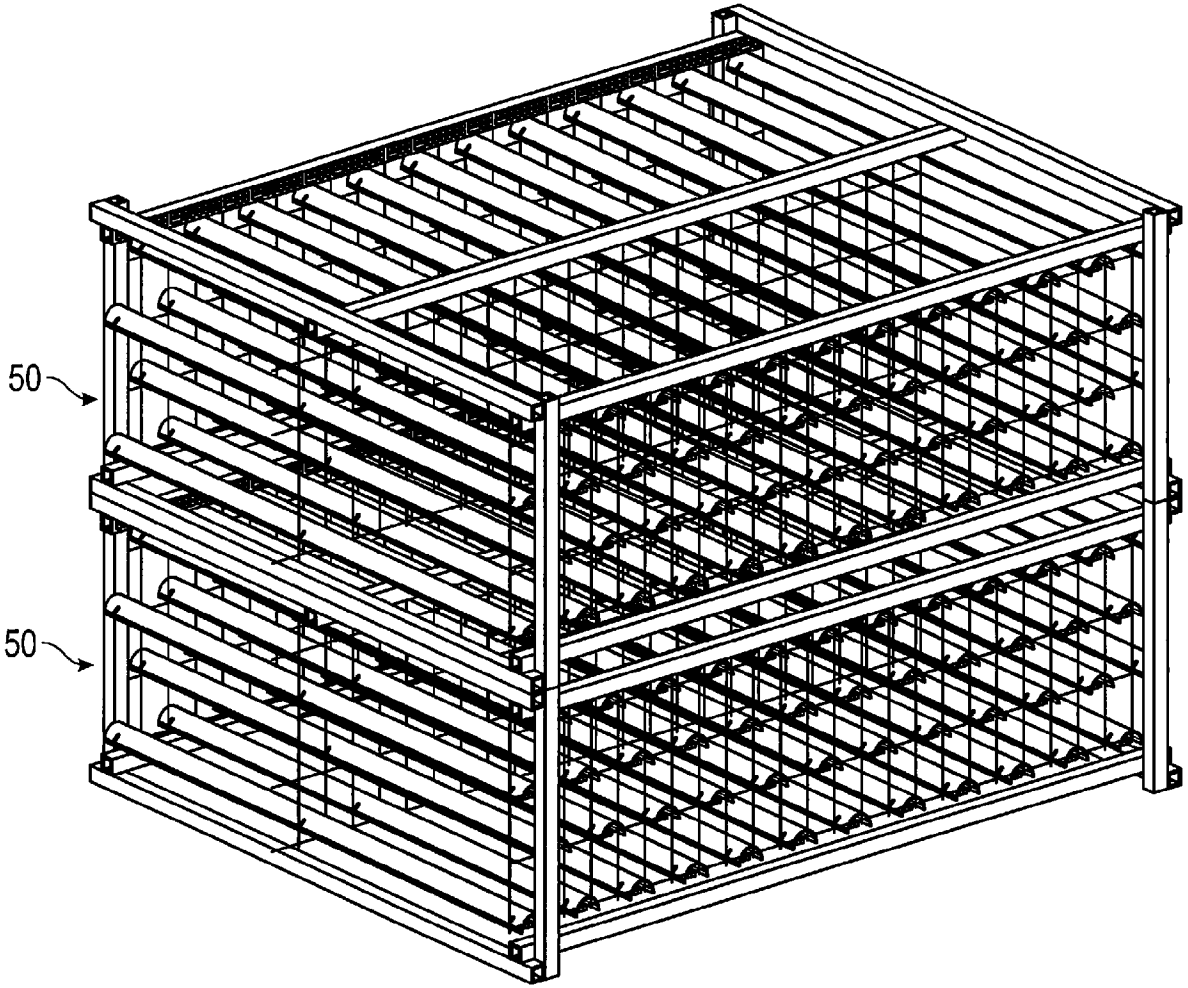
FIG. 7 is a perspective view of the fill module according to another aspect of the disclosure.

FIG. 7 is a perspective view of the fill module 50 according to another aspect of the disclosure. As shown in FIG. 7, the fill module 50 of this aspect is configured to be stacked, one upon the other, to generate the height that is about equal (slightly less) than the distance between the fill support beams 32 of one layer to the next (See FIG. 8). That is, in this aspect, two smaller height fill modules 50 are stacked and their combined heights are the same height as the single full height fill module 50. These smaller height fill modules 50 are sufficiently short enough to pass between the louvers 42.

Figure 8:
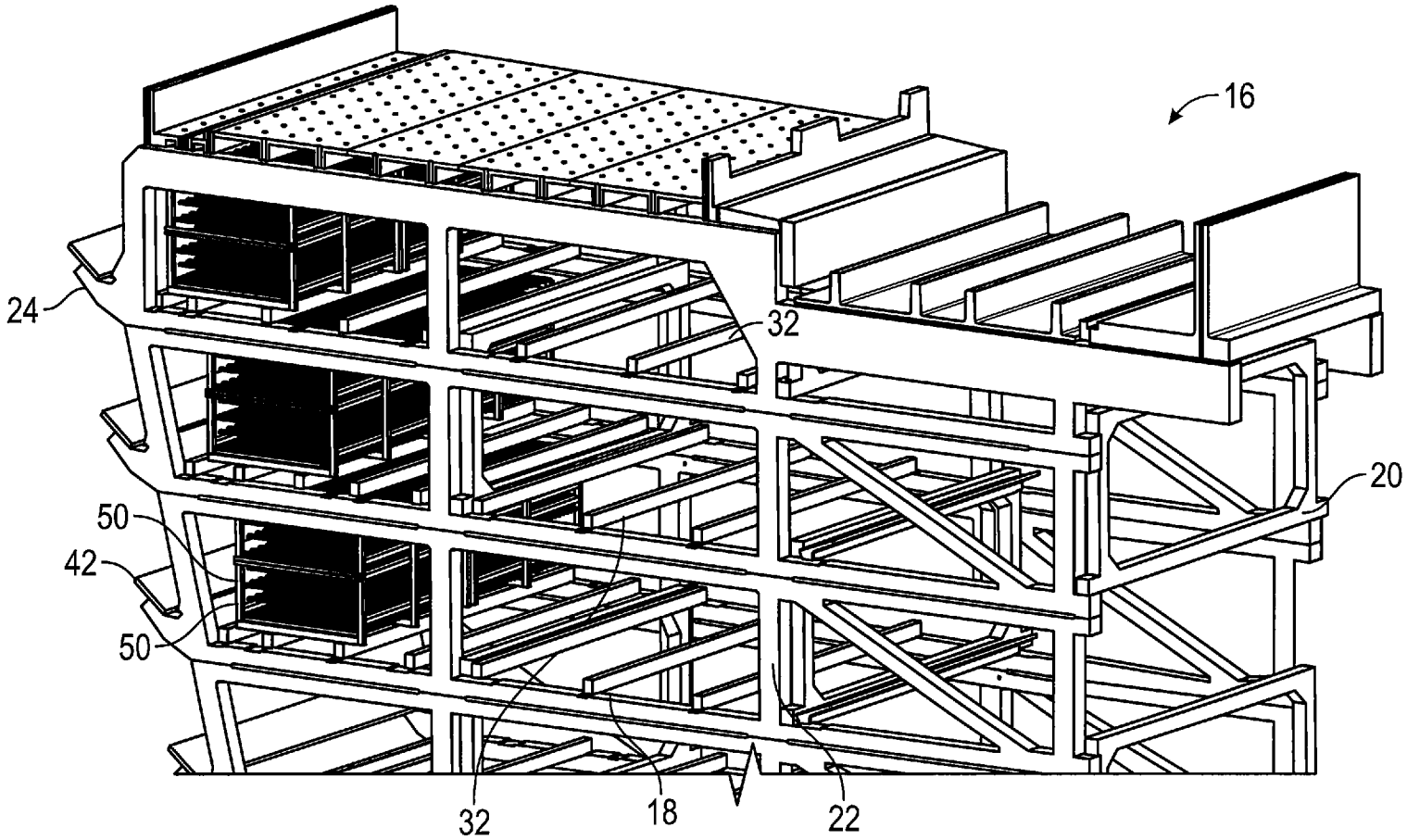
FIG. 8 is a perspective view of the fill module installed in the frame according to an aspect of the disclosure.

FIG. 8 is a perspective view of the fill module 50 installed in the fill support frame 16 according to an aspect of the disclosure. As shown in FIG. 8, the fill modules 50 are configured to be installed in the support frame 16 without removal of the louvers 42. As described further herein, a first half-height fill module 50 may be tilted into the opening above the louver 42 and then placed on the fill support beams 32 and then a second half-height fill module 50 may be inserted into the opening and disposed on top of the first half-height fill module 50. It is to be understood is that the modules may not be exactly half-height as the total number of bar layers may be odd and not evenly divisible.

Figure 9:
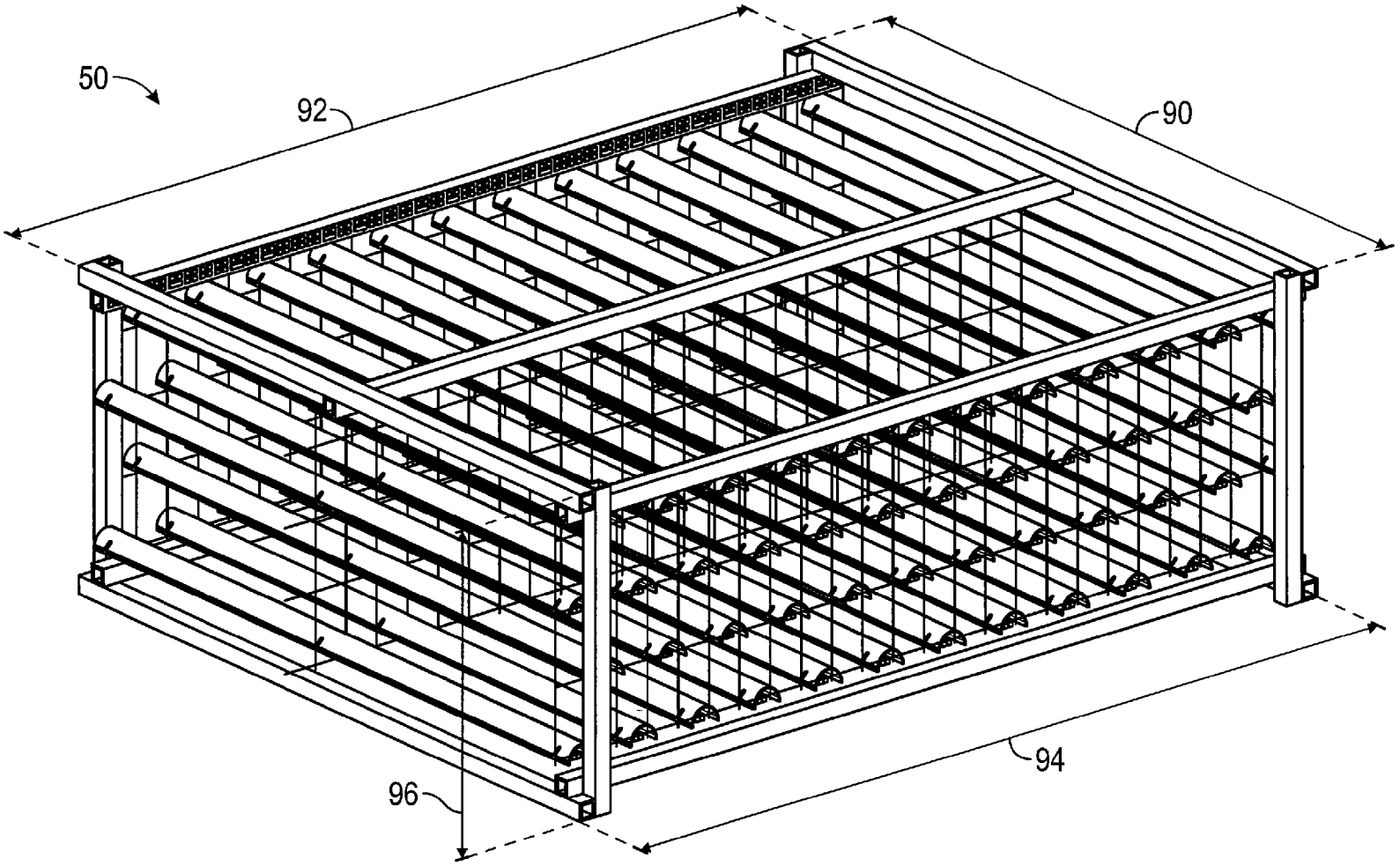
FIG. 9 is a perspective view of a fill sub-module according to the aspect of FIG. 7.

FIG. 9 is a perspective view of the half-height fill module 50 or a fill sub-module 50 according to the aspect of FIG. 7. In a particular installation in an annular fill support frame 16 that circles the cooling tower 10 and wherein the radius of the fill support frame 16 changes from one level to the next because of the sloping louver face of the fill support frame 16, dimensions of the fill module 50 may vary accordingly. For example, the radial dimensions change from level to level. Furthermore, as the radial dimensions change so do the circumferential dimensions. As shown in FIG. 9, the fill sub-module 50 includes a radial length 90, an outboard circumferential width 92, an inboard circumferential width 94, and a height 96. In a specific example, the radial length 90 is roughly 6 feet, the outboard circumferential width 92 is roughly 6 feet 3 inches, the inboard circumferential width 94 is slightly less than the outboard circumferential width 92, and the height 96 is about 3 feet. A nominal weight of the fill sub-module 50 is roughly 150 lbs.

Figure 10:
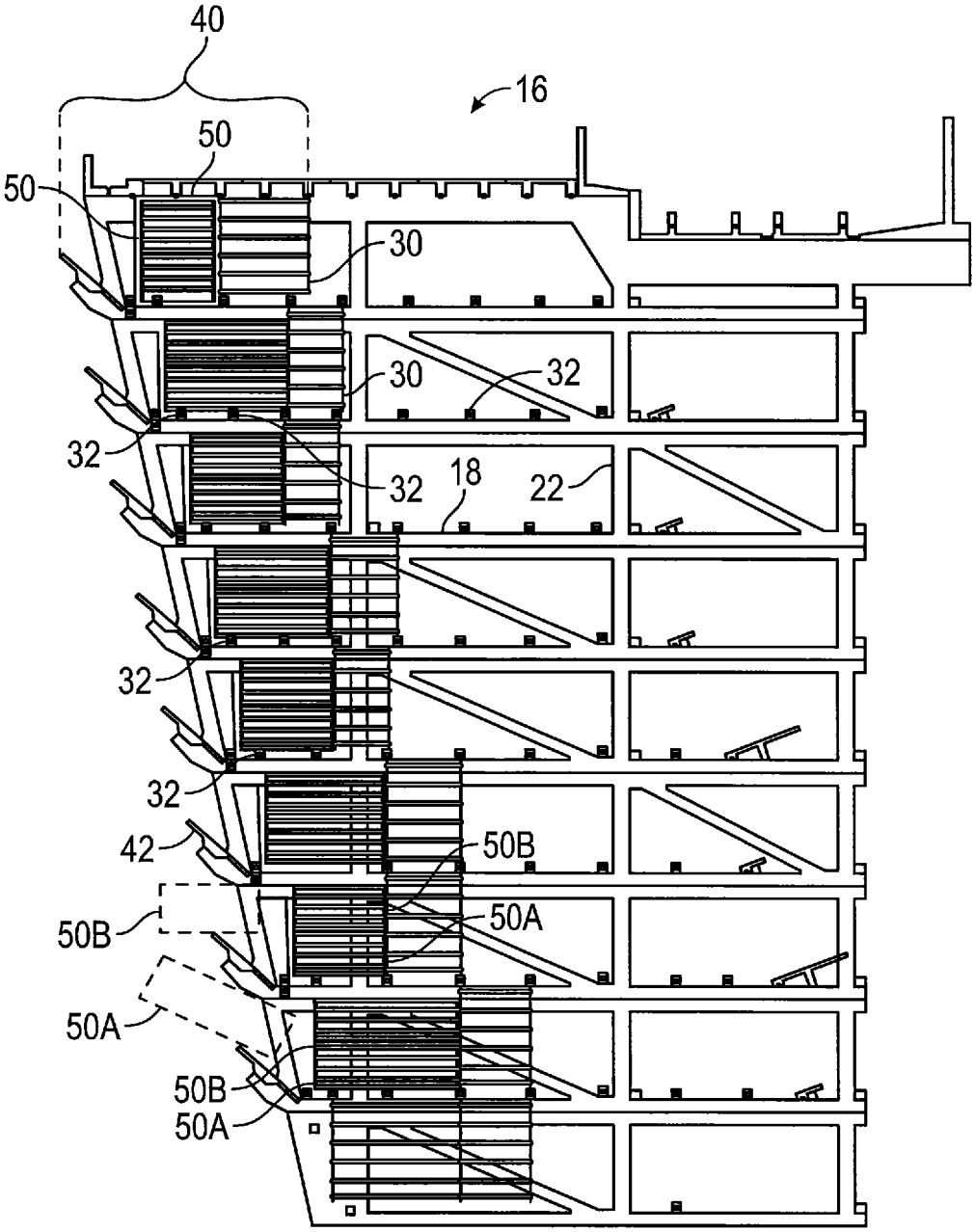
FIG. 10 is a side view of the fill installation in the frame of the cooling tower.

FIG. 10 is a side view of the fill module 50 installation in the fill support frame 16. As shown in FIG. 10, the fill modules 50 may co-exist with the conventional fill 30. This hybrid system may be particularly suitable in situations in which an existing fill support frame 16 is filled with conventional fill 30 and where the conventional fill 30 in the air inlet area 40 has been damaged while the remainder of the conventional fill 30 is undamaged. The damaged conventional fill 30 may be replaced by the fill modules 50 at a great savings in time and/or expense. This hybrid system may also be useful in some new installations in which it is anticipated that fill near the air inlet area 40 will be damaged but inboard fill would not be. In order to reduce time/expense in replacing the fill near the air inlet area 40, the fill module 50 may be used and in order to reduce materials, conventional fill 30 may be used in the remainder of the installation.

Also shown in FIG. 10, the fill module 50A may be installed without removal of the louvers 42 by lifting and tilting the fill module 50A into the opening between the louvers 42. Alternatively, the fill module 50A may be inserted into the opening in a level or horizontal manner and then a hoist may be used to support the fill module 50A while the forks are withdrawn. Thereafter, the hoist or other such device may lower the fill module 50A down onto the fill support beams 32. Thereafter, the fill module 50A may be disposed upon the fill support beams 32. The fill module 50B may be lifted and placed upon the fill module 50A.

Figure 11:
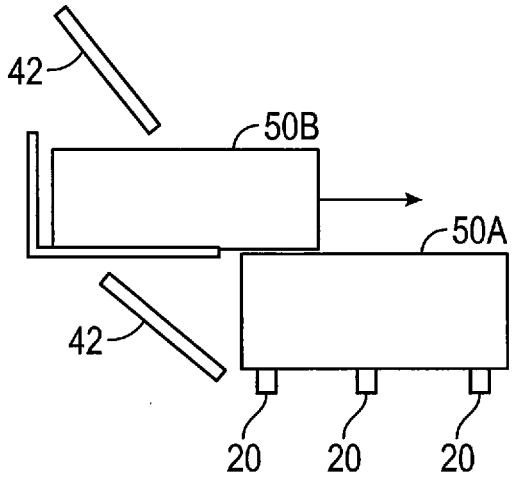
FIG. 11 is a side view showing a method of stacking the fill sub-modules in the frame according to an aspect.

FIG. 11 is a side view showing a method of stacking the fill sub-modules 50 in the fill support frame 16 according to an aspect. As shown in FIG. 11, the fill module 50B may be lifted, by a fork lift for example, and then inserted between the louvers 42 and on top of the fill module 50A. Of note, depending on the spacing between the louvers 42, three or more of the fill sub-modules 50 may be utilized to generate a full-height fill module 50.

Figure 12:
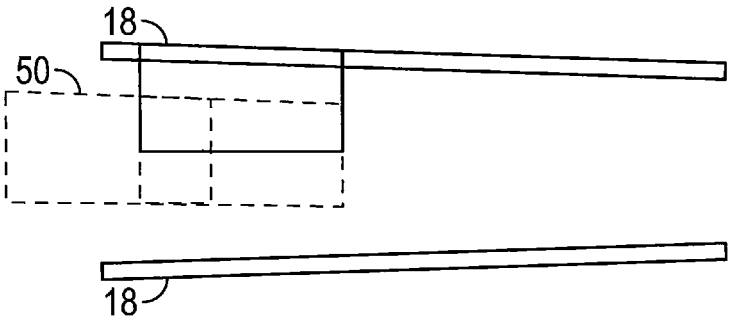
FIG. 12 is a top view showing a method of installing the fill modules in the frame according to an aspect.
Figure 13:
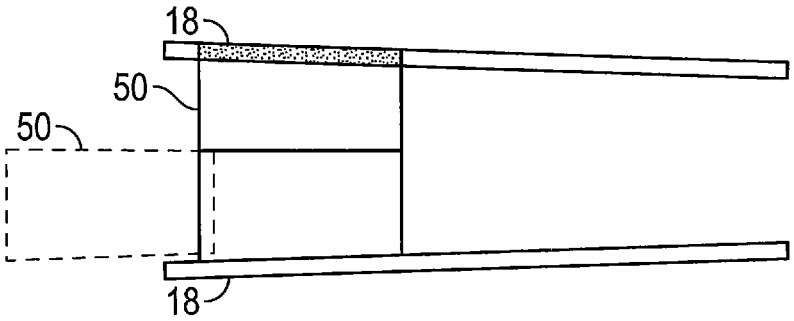
FIG. 13 is a top view showing a method of installing the fill modules in the frame according to an aspect.

FIG. 12 is a top view showing a method of installing the fill modules 50 in the fill support frame 16 according to an aspect. As shown in FIGS. 12 and 13, a pair of the fill modules 50 may be placed side by side between two adjacent radial framing members 18. In FIG. 12, the first fill module 50 is shown being inserted in at step 1, over at step 2, and resting in place at step 3. In FIG. 13, a second fill module 50 is shown being inserted between the first fill module 50 and the radial framing member 18.

It is a feature of this and other aspects that the fill modules 50 may be slid under the radial framing members 18. In other words the fill modules 50 occupy the voids at the radial framing members 18 that typically occur in conventional fill installations. However, in some instances diagonals may be present in some of the frame windows and the splash fill may be left out of these regions if permitted by the thermal design. In the FIGS. 12 and 13, no diagonals are present in the outboard windows.

Figure 14:
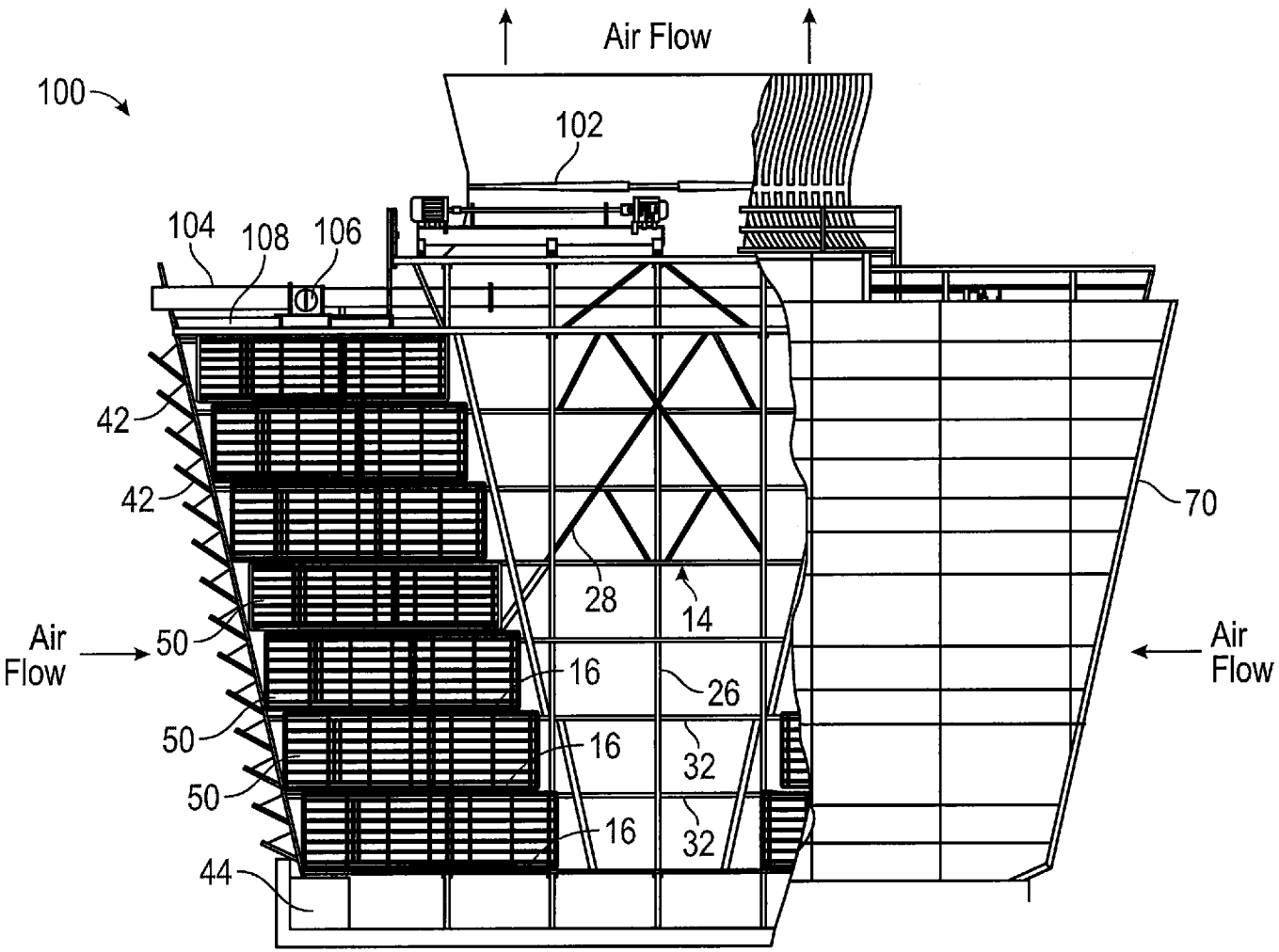
FIG. 14 is a partial cross sectional view of the cooling tower suitable for use with a rectilinear tower aspect of the present invention.

FIG. 14 is a partial cross sectional view of the cooling tower 10 suitable for use with a rectilinear tower aspect of the present invention. As shown in FIG. 14, the cooling tower 10 includes a casing 70, support structure 14, fill modules 50, a water supply assembly 100, catch basin 44, and a fan 102. The casing 70 is configured to control a flow of air across the fill modules 50. In this regard, ends of the cooling tower 10 may be configured to reduce air infiltration while the sides may include the louvers 42 to allow the flow of air to enter the cooling tower 10 and flow across the fill modules 50. In addition, the louvers 42 may be configured to redirect splashing water back into the cooling tower 10. The support structure 14 includes the fill support frame 16, columns 26, diagonal members 28, and fill support beams 32.

The water supply assembly 100 includes a water supply line 104, flow control valves 106, and a distribution basin 108. The water supply line 104 is configured to convey water and/or other coolant from a suitable heat source to the distribution basin. Suitable heat sources include, for example, a power plant, refrigeration unit, or the like. The flow control valve 106 is configured to modulate the flow of water from the water supply line 104 to the distribution basin 108. The distribution basin 108 is configured to provide a substantially evenly distributed flow of the water across the top of the fill modules 50. The fill modules 50 are configured to further distribute or otherwise increase the surface area of water interacting with the flow of air supplied by the fan 102. In this manner, waste heat is removed from the water. Thereafter, the cooled water is collected in the catch basin 44.

As shown in FIG. 14, the fill modules 50 may be full or partial depth. For example, if the fill modules 50 are going to be slid into position from within the cooling tower 10, it may be cramped—particularly at or near the bottom. In these situations or for other reasons, it may be beneficial that the fill modules 50 are less than the full length of the fill portion of the cooling tower 10. In addition, as already described herein, the fill modules 50 may be full height or partial height.

Figure 15:
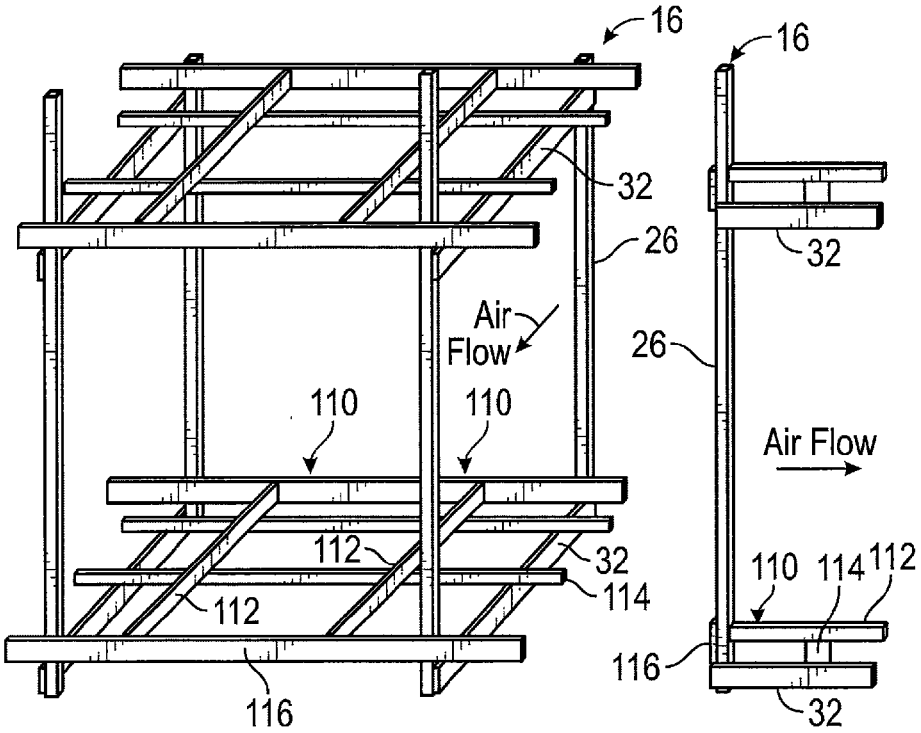
FIG. 15 is an orthogonal projection and side view of the fill support frame according to an aspect.

FIG. 15 is an orthogonal projection and side view of the fill support frame 16 according to an aspect. As shown in FIG. 15, the fill support frame 16 includes a sliding assembly 110 to facilitate sliding the fill module 50 into the fill support frame 16. In this aspect, the sliding assembly 110 includes transverse members 112 resting on existing girts 114 and longitudinal members 116 securing the ends of the transverse members 112.

Figure 16:
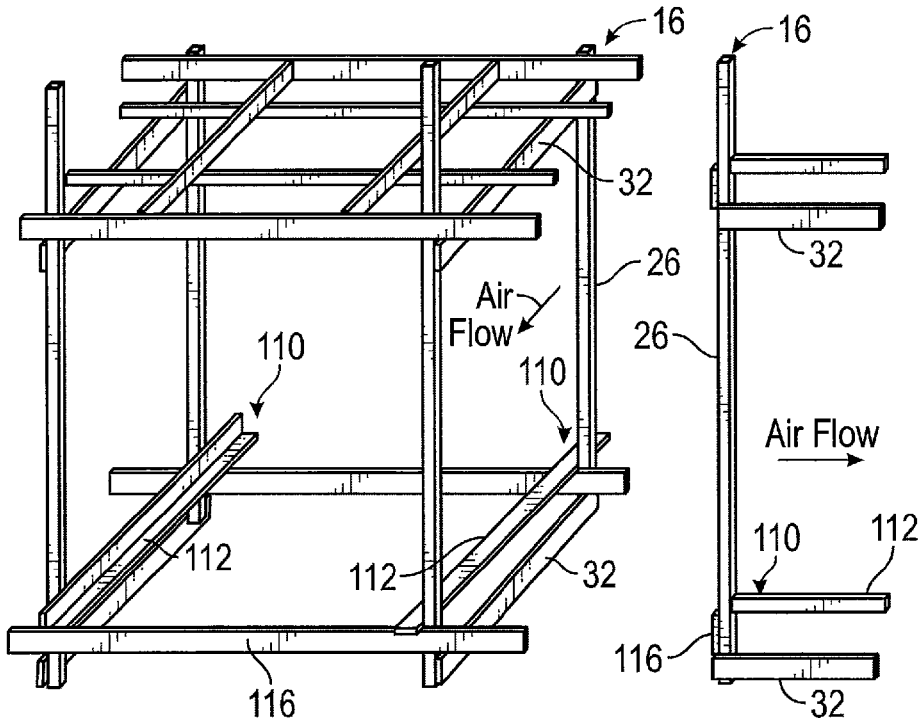
FIG. 16 is an orthogonal projection and side view of the fill support frame according to another aspect.

FIG. 16 is an orthogonal projection and side view of the fill support frame 16 according to another aspect. As shown in FIG. 16, the sliding assembly 110 includes the transverse members 112 resting on existing longitudinal members 116. In this aspect, one or both of the transverse members 112 may be angled in a similar manner to structural angles in order to facilitate guiding the fill module 50 into the space between the columns 26.

Figure 17:
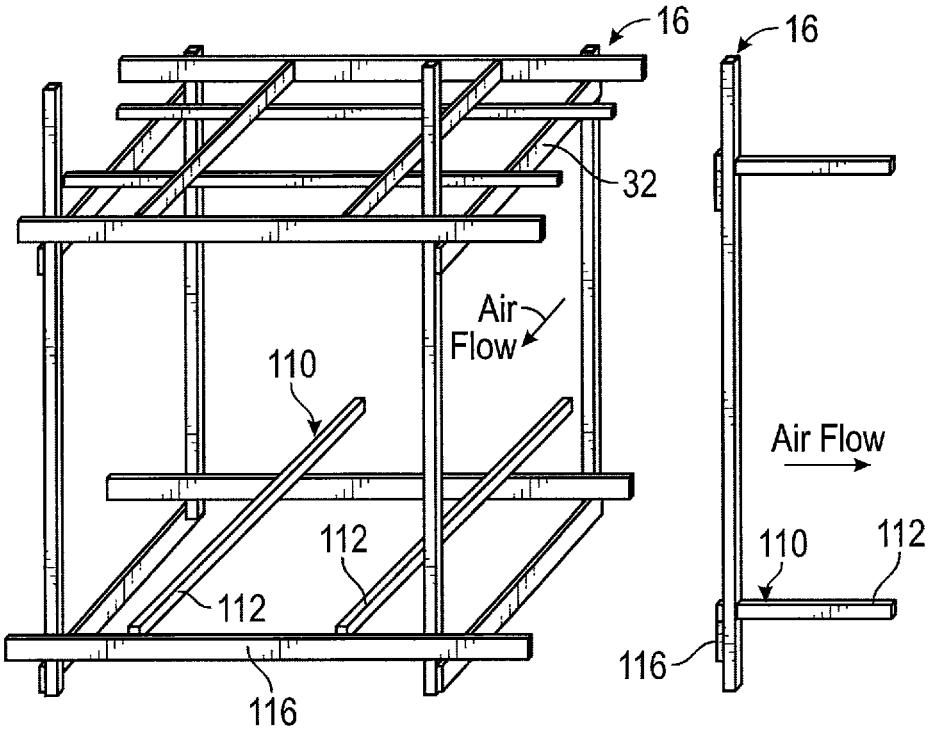
FIG. 17 is an orthogonal projection and side view of the fill support frame according to yet another aspect.

FIG. 17 is an orthogonal projection and side view of the fill support frame 16 according to yet another aspect. As shown in FIG. 17, the sliding assembly 110 includes the transverse members 112 resting on existing longitudinal members 116. In this aspect, the transverse members 112 may be relatively small elements that are attached or resting on the longitudinal members 116.

Figure 18:
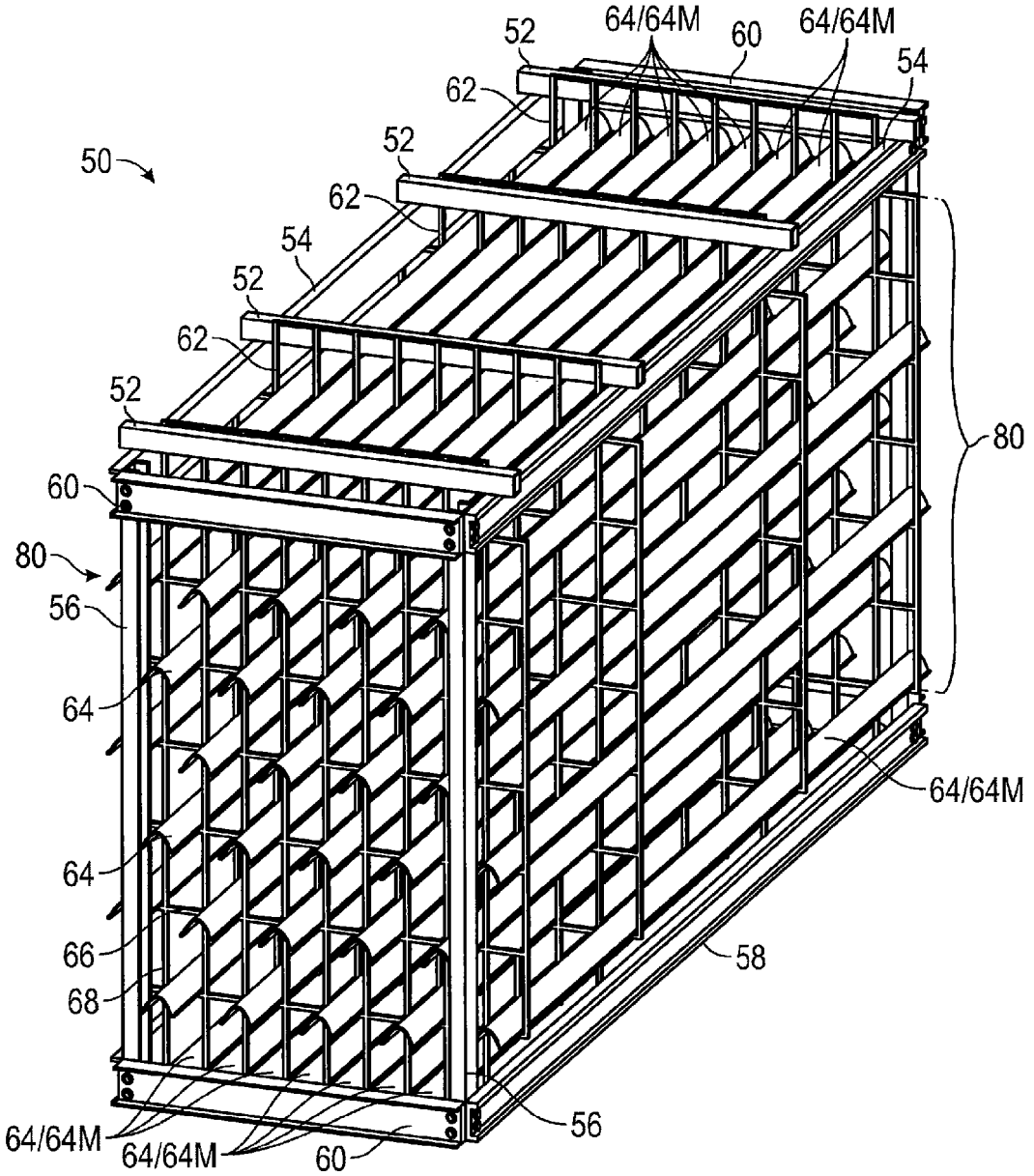
FIG. 18 is a perspective view of the fill module according to an aspect of the disclosure.
Figure 19:
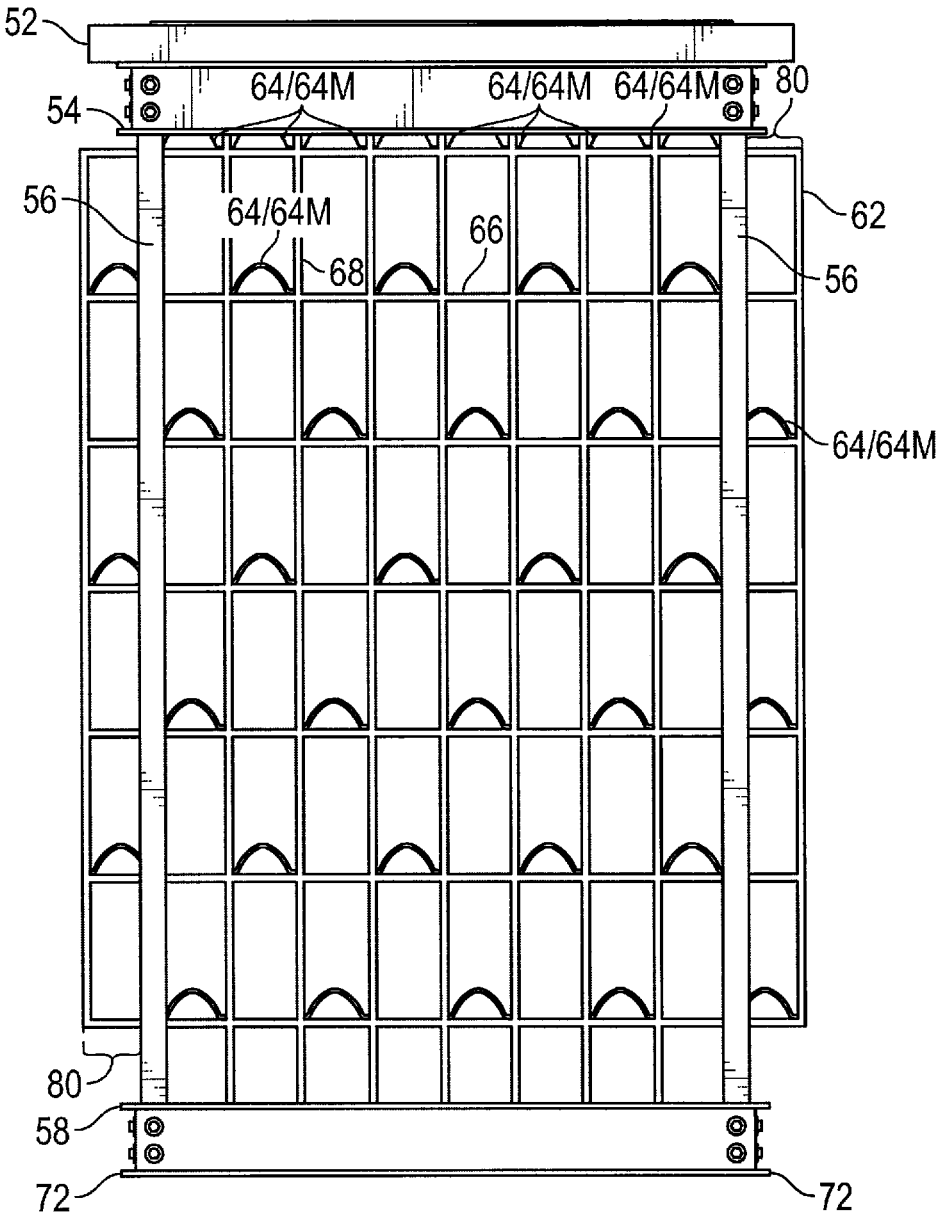
FIG. 19 is a front view of the fill module according to an aspect of the disclosure.
Figure 20:
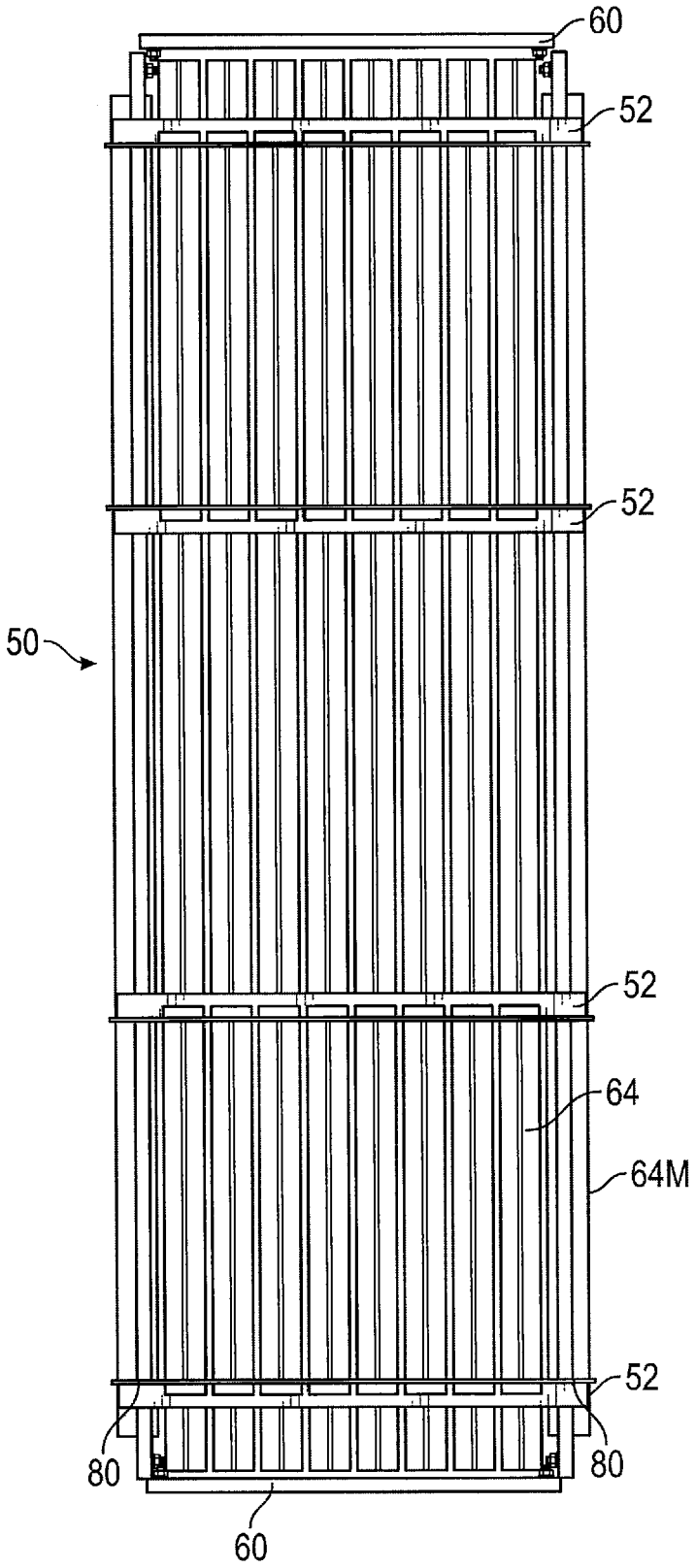
FIG. 20 is a top view of the fill module according to an aspect of the disclosure.
Figure 22:
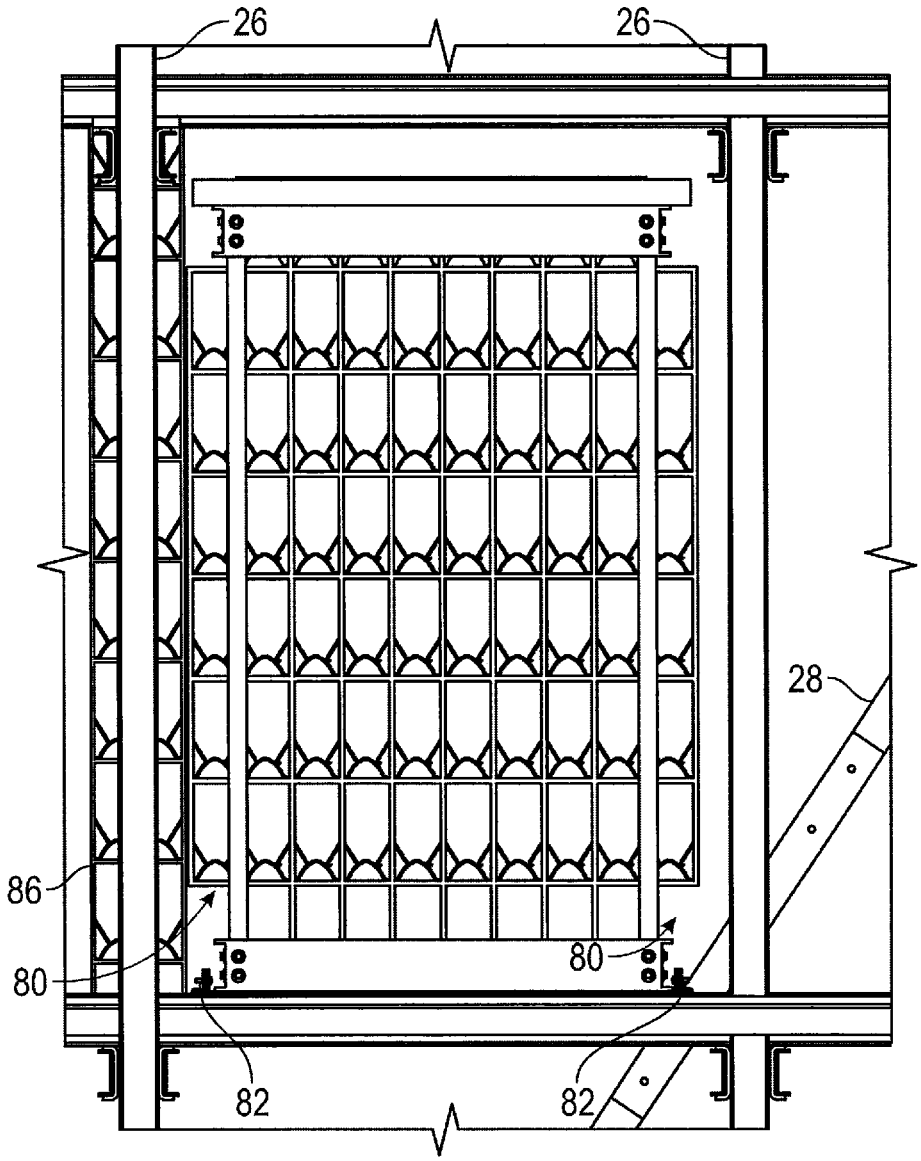
FIG. 22 is a front view of the fill module installed in the fill support frame according to an aspect of the disclosure.

FIG. 18 is a perspective view of the fill module 50 according to an aspect of the disclosure. The fill module 50 shown in FIG. 18 is similar to the fill module 50 described hereinabove and thus, for the sake of brevity, those items described hereinabove may not be described again. As shown in FIG. 18, the fill module 50 includes the plurality of grid supports 52, module side supports 54, module columns 56, module side girts 58, module end girts 60, grids 62, and splash fill bars 64. In addition, the fill module 50 includes the grids 62 with one or more extensions 80. The extensions 80 may be more clearly seen in FIG. 19 and may be configured to retain one of more extra columns of splash fill bars 64 or modified splash fill bars 64M that have been modified to extend out from the fill module 50. In a particular example, the modified splash fill bars 64M may be shortened to fit between the module columns 56. A comparison of the relative lengths of the splash fill bars 64 and modified splash fill bars 64M may be better seen in FIG. 20. In other examples, the modified splash fill bars 64M may be narrower, wider, taller, or shorter than the splash fill bars 64. It is an advantage of the extensions 80 that a greater proportion of the fill support frame 16 shown in FIG. 22 is filled with the fill bars 36 which, in turn, facilitates greater heat dissipation in the cooling tower 10 shown in FIGS. 2 and 14. Also shown in FIG. 18, a top and/or bottom row of the splash fill bars 64 may fill every available location in the grids 62. It is an advantage of this arrangement that water may be better dispersed as it enters and/or leaves the fill module 50. If this first and/or last row is disposed in alignment with the module end girts 60, the grids 62 may be filled with the modified splash fill bars 64M.

According to various aspects of the disclosure, the fill module 50 includes a slide member 72. In various examples, the slide member 72 may be disposed on a bottom and/or side surface of the modular side support 54. The slide member 72 is configured to facilitate sliding the fill module 50 such as, for example, during installation into the fill support frame 16 or other moving operation. In this regard, the slide member 72 may include an abrasion resistant surface and/or the lubricity properties may be modified to facilitate sliding.

Figure 21:
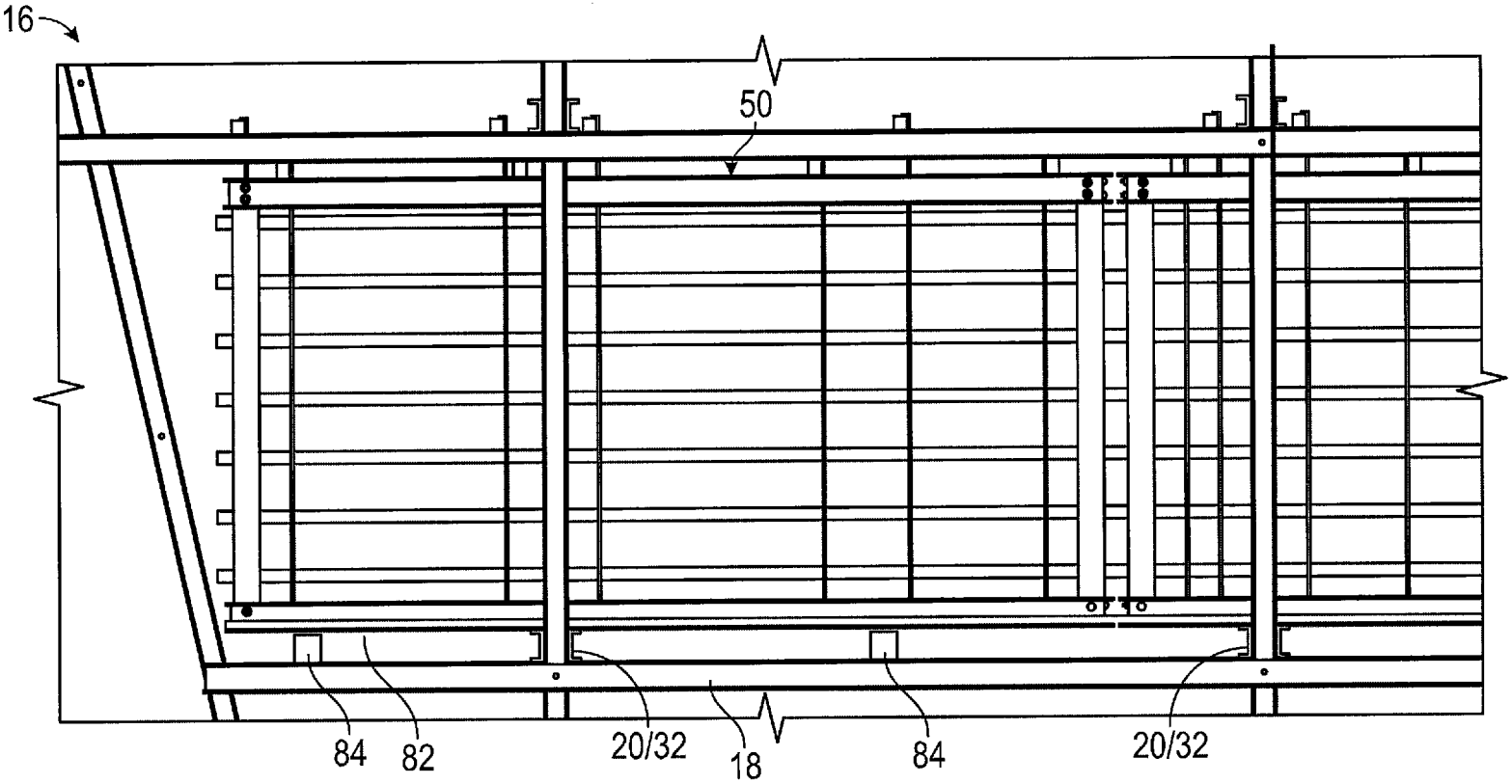
FIG. 21 is a side view of the fill module installed in the fill support frame according to an aspect of the disclosure.
Figure 23:
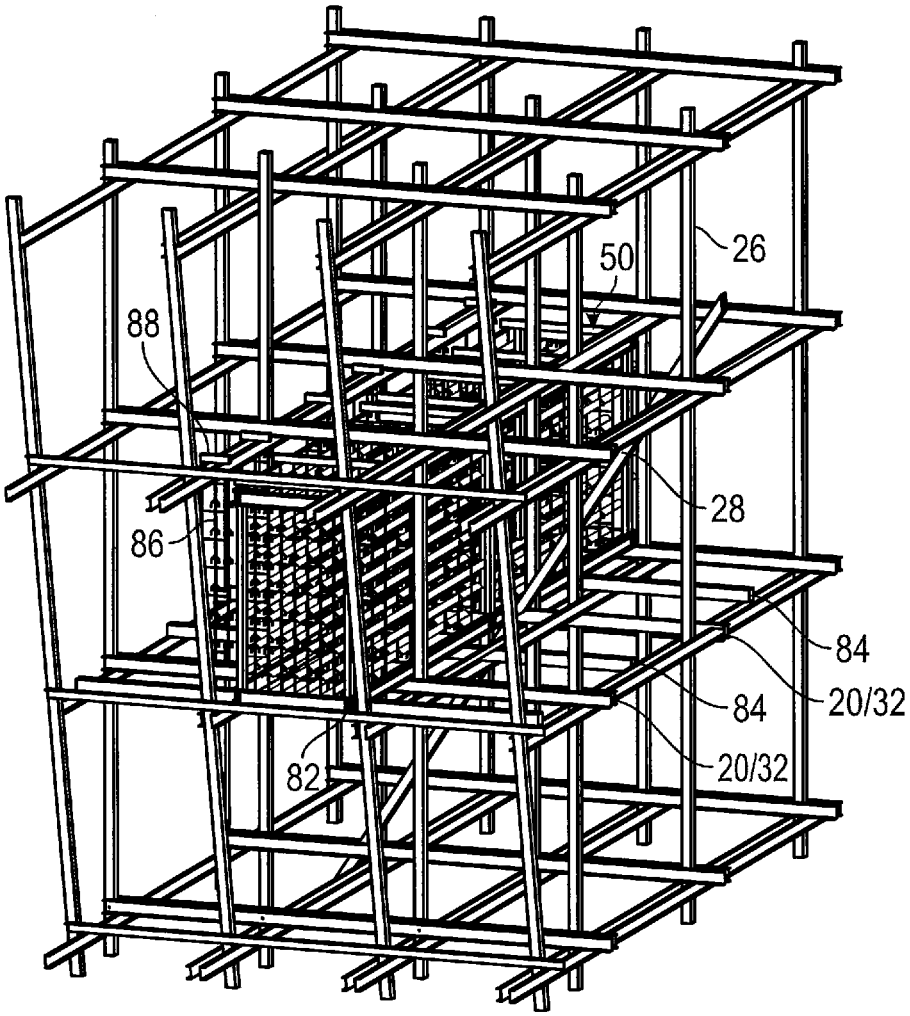
FIG. 23 is a perspective view of the two fill modules installed in the fill support frame according to an aspect of the disclosure.

FIG. 21 is a side view of the fill module 50 installed in the fill support frame 16 according to an aspect of the disclosure. As shown in FIGS. 21-23, the fill support frame 16 includes a plurality of rails 82 configured engage the slide members 72 and provide a surface for the sliding members to slide upon and/or to provide support for the fill module 50. In a particular example, the module side girts 58 may be configured to slide on the rails 82 during installation of the fill modules 50 and rest up the rails 82 while in use. The rails 82 may be supported by the circumferential framing members 20 and/or the fill support beams 32. In addition, one or more rail support beams 84 may be used to support the rails 82. The rail support beams 84 may, in turn, rest upon the radial framing members 18 and/or the fill support beams 32. The rails 82 may be configured to be particularly suitable for engaging the slide members 72. Particular examples of engagement between the rails 82 and slide members 72 may include sliding and supporting the fill module 50. The rails 82 may include "L-shaped" brackets to engage a bottom surface of the plurality of the slide members 72 and engage a side surface of the plurality of the slide members 72.

FIG. 22 is a front view of the fill module 50 installed in the fill support frame 16 according to an aspect of the disclosure. As shown in FIG. 22, the fill module 50 is sized to avoid interfering with the diagonal members 28. While this reduced size of the fill module 50 facilitates use with the diagonal members 28, some volume of fill would be lost without the extensions 80 providing support for the splash fill bars 64. Also shown in FIG. 22, a supplemental grid 86 may be optionally disposed in the fill support frame 16 to provide support for the splash fill bars 64 between the columns 26. If included, the supplemental grid 86 may be supported with supplemental grid supports 88 shown in FIG. 23.

In yet another embodiment of the present invention, the rails 82 may be positioned oriented parallel to one another to received sliding members 72, for example in cooling towers or the like having annular fill sections. Yet in such embodiments, the modules may be trapezoidal in geometry with the outboard face of the module being wider than the inboard face. The aforementioned trapezoid geometry may be accomplished by orienting the overhangs wider at the outboard face as compared to the inboard face. However, alternatively, in yet another embodiment, the "hand stuffed" grids positioned in the shadow of the frame can be extended further, closer to the outboard face. Still yet another embodiment of the present invention, additional framing could be employed at the bottom of module that allows for and engages sliders in parallel relationship.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for installing a fill in an evaporative cooling tower, the method comprising the steps of:

assembling a fill module, the fill module comprising:

a grid to support a plurality of splash bars;

a grid support configured to provide support for the grid;

a module support configured to provide support for the grid support;

a module column configured to provide support for the module support;

a plurality of module girts to provide support for the module columns; and a plurality of slide members configured to facilitate sliding the fill module on a plurality of rails in the evaporative cooling tower;

lifting the fill module;

engaging the plurality of slide members with the plurality of rails;

disposing the fill module over a louver of the fill frame support and inserting the fill module into the fill frame support without removal of the louver; and sliding the fill module into the evaporative cooling tower.

2. The method according to claim 1, wherein the plurality of rails are "L-shaped" and the method further comprises the step of:

engaging a bottom surface of the plurality of the slide members and a side surface of the plurality of the slide members with the plurality of rails.

3. The method according to claim 1, further comprising the steps of:

sliding the fill module past a diagonal member.

4. The method according to claim 1, further comprising the step of:

extending the grid with extensions configured to support a plurality of extension splash bars.

5. The method according to claim 1, further comprising the step of:

disposing a plurality of rail support beams across adjacent pairs of horizontal framing members disposed in the evaporative cooling tower to provide support for the plurality of rails.

6. A method for installing a fill in an evaporative cooling tower, the method comprising the steps of:

assembling a fill module, the fill module comprising:

a grid to support a plurality of splash bars;

a grid support configured to provide support for the grid;

a module support configured to provide support for the grid support;

a module column configured to provide support for the module support;

a plurality of module girts to provide support for the module columns; and a plurality of slide members configured to facilitate sliding the fill module on a plurality of rails in the evaporative cooling tower;

extending the grid with extensions configured to support a plurality of extension splash bars;

lifting the fill module;

engaging the plurality of slide members with the plurality of rails; and sliding the fill module into the evaporative cooling tower.

7. The method according to claim 6, wherein the plurality of rails are "L-shaped" and the method further comprises the step of:

engaging a bottom surface of the plurality of the slide members and a side surface of the plurality of the slide members with the plurality of rails.

8. The method according to claim 6, further comprising the steps of:

sliding the fill module past a diagonal member.

9. The method according to claim 6, further comprising the step of:

disposing a plurality of rail support beams across adjacent pairs of horizontal framing members disposed in the evaporative cooling tower to provide support for the plurality of rails.

* * * * *